US005992064A

United States Patent [19]

Gubernick

[11] Patent Number: 5,992,064

[45] **Date of Patent: *Nov. 30, 1999**

[54] DEFORMABLE HANDHELD CALENDAR

[76] Inventor: Franklin L. Gubernick, 2540 N. Rising Star Tr., Tucson, Ariz. 85745

[ * ] Notice: Under 35 U.S.C. 154(b), the term of this patent shall be extended for 7 days.

[21] Appl. No.: 08/612,814

[22] Filed: Mar. 11, 1996

Related U.S. Application Data

[60] Provisional application No. 60/000,193, Jun. 14, 1995.

[51] Int. Cl.[6] ..... G09D 3/00; A63B 23/16

[52] U.S. Cl. ..... 40/107; 482/40; 273/584

[58] Field of Search ..... 40/107; 446/267, 446/369; 482/49; 273/561 H, 58 F

[56] References Cited

U.S. PATENT DOCUMENTS

| | | | |
|---|---|---|---|
| 1,444,012 | 2/1923 | Thomas | 40/107 X |
| 3,601,923 | 8/1971 | Rosencberg . | |
| 5,026,054 | 6/1991 | Osher et al. | 446/267 X |
| 5,190,504 | 3/1993 | Scatterday . | |
| 5,350,342 | 9/1994 | Scatterday | 482/49 |

*Primary Examiner*—Cassandra H. Davis
*Attorney, Agent, or Firm*—Franklin Gubernick

[57] ABSTRACT

A deformable calendar in the form of a ball-shaped device sized to fit a user's hand and having a tabular register of days and months printed on its exterior surface. The device has a tightly-packed particulate core and a resilient outer covering. A user can increase the size of any part of the printed register by manually stretching the associated part of the covering. The printed register is preferably located on at least two opposite sides of the device so that a user can view any part of the register by a suitable manual manipulation of the device.

12 Claims, 5 Drawing Sheets

DEFORMABLE HANDHELD CALENDAR

This application claims the benefit of U.S. Provisional Application No. 60/000,193 filed Jun. 14, 1995.

FIELD OF THE INVENTION

The invention is in the field of calendars. More particularly, the invention is a ball-shaped device that has a tabular register of months and days located about its exterior surface. The device is designed to be handheld and deformable. The outer surface of the device is resilient and may be locally stretched to thereby magnify the size of the printed matter in the stretched area.

BACKGROUND OF THE INVENTION

A calendar is typically in the form of one or more flat sheets of paper or the like that have a printed tabular register of months and days on one surface thereof. The calendar is usually adapted to be hung on a wall or located on a desk so that it is readily viewable.

Prior art calendars are not adapted to be easily handheld. Their form does not engender a user's holding them for any period of time. In addition, prior art desk-located calendars require a significant amount of space and are often inadvertently covered up by papers whereby the calendar is not readily visible or accessible.

SUMMARY OF THE INVENTION

The invention is a ball-shaped calendar device that is readily deformable and has a tabular register of months and days in calendar form printed about its exterior surface. The device is preferably of a size that allows it to be easily held in a single one of a user's hands whereby the device may be rotated within the hand to allow the user to view any portion of the printed tabular register.

In the preferred embodiment, the device has a core comprised of a tightly-packed mass of hard, organic particles such as millet. An example of this type of core can be found in the Scatterday patent (U.S. Pat. No. 5,190,504). Alternatively, the core can be composed of other types of particles such as steel shot or beads. As another alternative, the device may make use of a deformable core composed of a liquid material such as that taught by Rosenberg (U.S. Pat. No. 3,601,923).

A resilient material is used to contain the core. In the preferred embodiment, the resilient material is in the form of a set of nested rubber sacks. The outer sack that forms the exterior surface of the device includes printed indicia on its surface. The indicia is in the form of a six or twelve month tabular register of days and months in calendar form that allows the device to function as a calendar. The different months of the calendar are spaced about the perimeter of the device. In the preferred embodiment, the months of the calendar are located in two or more groups with said groups located on opposite sides of the device.

The use of a resilient covering about a deformable core provides the device with a number of advantages. The device may be easily deformed and is thereby comfortable for a user to mold to fit the contours of his or her hand. In addition, a user can deform the device repeatedly as an exercise or stress-relieving tool. Due to the device's relatively small surface area (approximately five square inches), a user may occasionally desire to magnify the size of a portion of the calendar. The structure of the invention makes this easily achievable. A user can manually stretch a portion of the resilient outer covering and thereby increase the size of the printed material in that particular area.

DETAILED DESCRIPTION OF THE DRAWINGS

Figure 1:
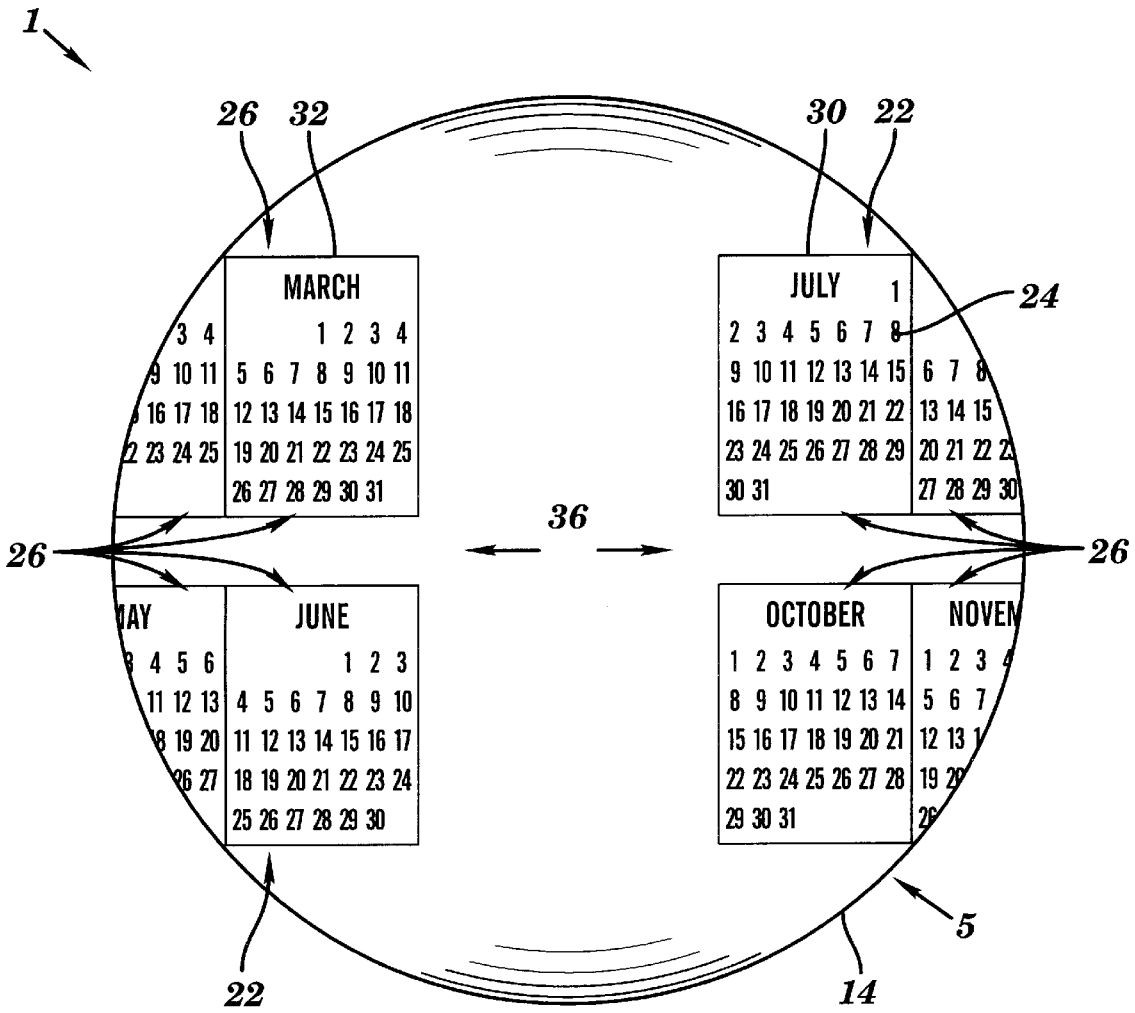
FIG. 1 is a front view of a deformable calendar device in accordance with the invention. The device is shown at approximately a 2× scale.
Figure 2:
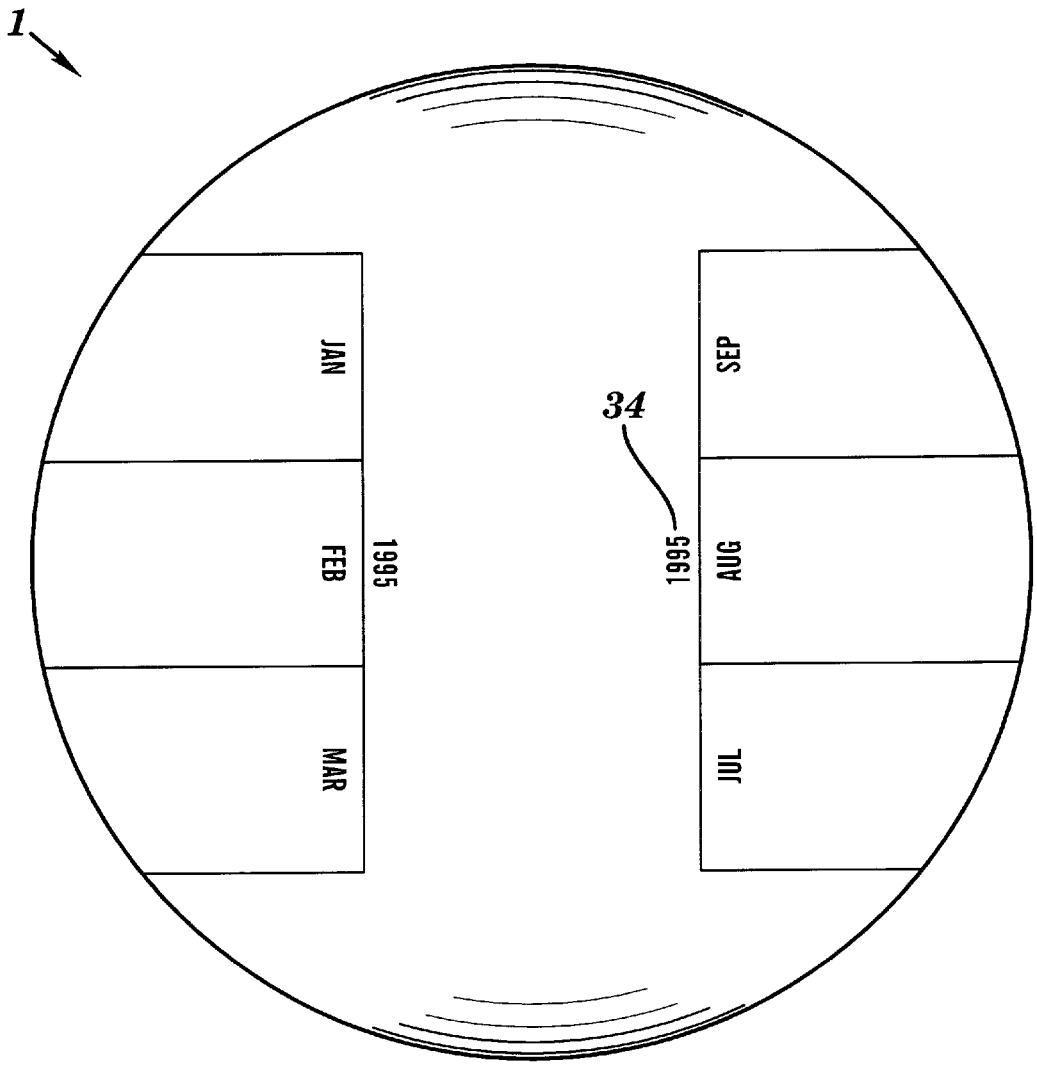
FIG. 2 is a generalized, non-detailed top view of the deformable calendar device shown in FIG. 1.

Referring now to the drawings in greater detail, wherein like reference characters refer to like parts throughout the several figures, there is shown by the numeral 1 a deformable calendar device in accordance with the invention.

The device is preferably ball-shaped and has a diameter of approximately two to four inches. In the preferred embodiment, the device has a diameter of approximately 2.5 inches. The size of the device enables it to be comfortably handheld. In the preferred embodiment, the device has a total weight of one pound or less.

Figure 3:
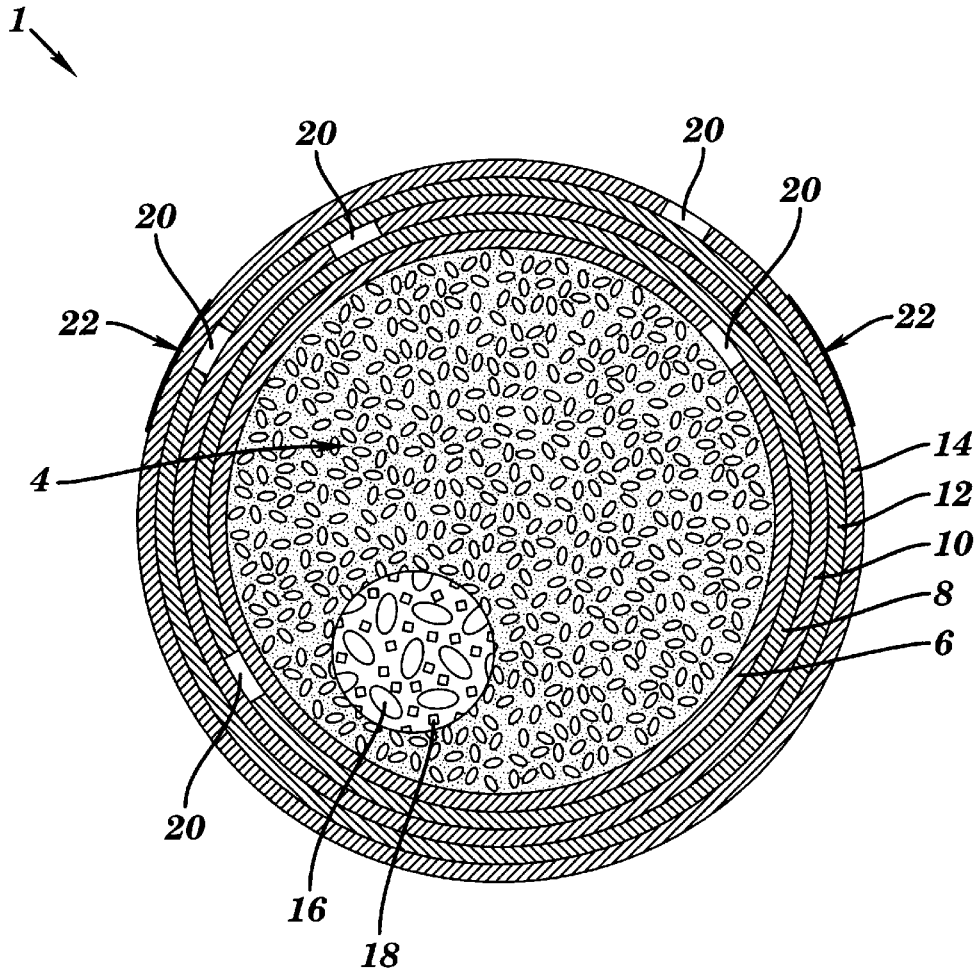
FIG. 3 is a cross-sectional view of the deformable calendar device shown in FIG. 1. In this view, the device is shown at approximately true scale with one portion shown in a magnified condition.

FIG. 3 provides a cross-sectional view of the device whereby its internal structure may be viewed. As can be seen, the device includes a core 4 that is surrounded by a covering 5. The covering is comprised of a plurality of latex rubber sacks 6, 8, 10, 12 and 14.

The core of the device is basically non-resilient and comprises a tightly-packed mass of loose particles 16. In practice, seeds such as millet are used as the particles. As an alternative, the particles 16 can be in the form of metal shot, plastic or silicon beads, or any other matter that is relatively small in size and has a configuration that allows a rolling action whereby one particle may roll against another. The latter condition enables the core to readily deform under pressure. In addition, the particles are preferably hard enough to withstand the compressive pressures experienced when the device is being squeezed by a user. As another alternate embodiment, the device may employ a liquid core (not shown). In the latter embodiment, the liquid may be water or a liquid mixture such as that taught in the Rosenberg patent (U.S. Pat. No. 3,601,923). While the latter alternate embodiment is not shown, the mass of particles 16 shown in FIG. 3 would merely be replaced by a quantity of liquid.

In the preferred embodiment, a powder-type dry lubricant 18 such as talc is mixed in with the particulate material 16.

This combination of materials allows the relatively small particles to slide over each other without damage or excessive amounts of friction.

Each of the latex rubber sacks 6, 8, 10 12 and 14 are very thin, have an aperture 20 and are round in shape when in an undeformed state. Prior to receiving the core, each sack is similar to a round balloon that is in a deflated condition.

The device 1 is produced by first filling sack 6 with a predetermined quantity of particles 16 and talc 18 via aperture 20. The latex material of the sack stretches but tends to maintain the round shape it had when in a non-stretched condition. Once sack 6 has been filled, it is inserted into the aperture 20 of sack 8. This procedure is repeated until all of the sacks are located about the core as shown in FIG. 3 with the apertures 20 of adjacent layers offset from each other.

The outermost sack 14 has a printed tabular register 22 of indicia that enables the device to be used as a calendar. The indicia define the days and months of a predetermined calendar year. There are numeric indicia 24 that define the days of each month. There are twelve groupings 26 of the indicia 24 that define the twelve months of the predetermined year. It should be noted that the device may employ fewer than twelve groupings 26. For example, if the device is to be used as a six month calendar, there would only be six groupings 26.

A linear border 30 surrounds the numerical indicia 24 of each grouping/month 26. Each month furthermore has alphanumeric indicia 32 that labels the particular numerical grouping 26 with the corresponding month such as "March." In the preferred embodiment, the device also includes numeric indicia 34 that are spaced apart from the other indicia and indicate the particular year of the calendar, such as "1995."

As shown, the groupings/months 26 are deployed in two spaced-apart larger groupings 36 with each larger grouping containing six groupings/months 26. The two larger groupings are preferably located on opposite sides of the device 1. Alternatively, the months 26 may be evenly spaced from each other and completely encircle the perimeter of the device. As another alternate, the months can be placed in four groupings about the device's perimeter with the center of each larger grouping being offset from the center of any adjacent grouping by approximately ninety degrees. It should be noted that other patterns of arranging the months may also be employed. The shape of the device enhances its ability to be manipulated by the user whereby the user can easily rotate the device to bring any portion of the indicia into view. This feature enables the indicia to be located anywhere on the surface of the device and still be easily viewable.

Figure 4:
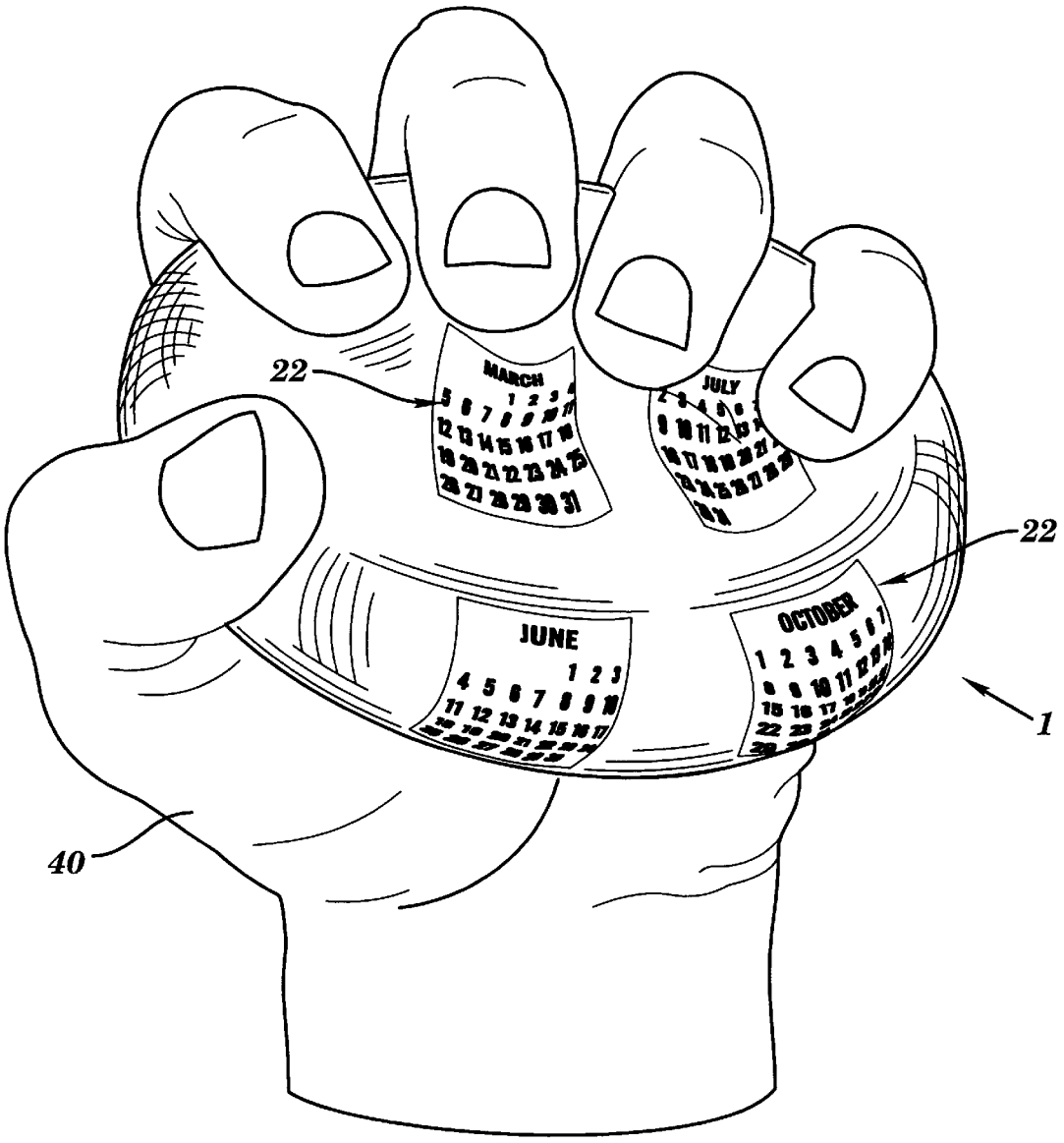
FIG. 4 shows the deformable calendar device of FIG. 1 in a deformed condition and located within the hand of a user.

FIG. 4 shows the device in a deformed condition and located within a user's hand 40. This figure portrays the easy manner in which a user may comfortably deform the device in order to have it more comfortably fit the user's hand. This figure also shows that the device may be easily manipulated so that the surface of the device facing the user will display any particular desired portion of the tabular register 22.

Figure 5:
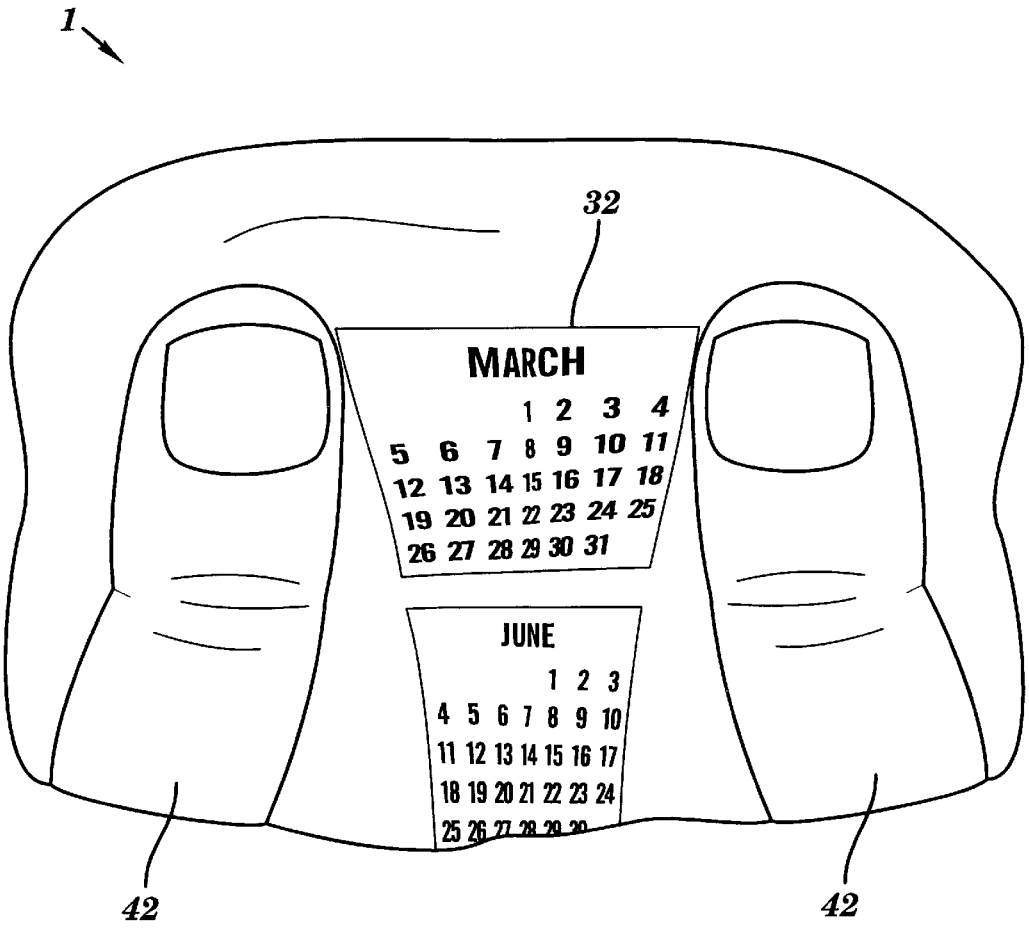
FIG. 5 shows a portion of the deformable calendar device of FIG. 1. In the figure, a portion of the device has been stretched by two of a user's fingers to thereby increase the size of the printing in the stretched area.

FIG. 5 shows a unique functional aspect of the invention that is directly enabled by its structure. A user can hold the device in one or both hands and use his or her fingers 42 to stretch a portion of the device's outer covering 5. This causes any printed matter located on the stretched area of the covering to likewise expand. In this manner, a user can physically cause a magnification of any desired portion of the register 22 by a proper manipulation of the device's covering. This is demonstrated in FIG. 5 where a user has stretched the month of March to thereby temporarily increase its size relative to that of the other months located on the exterior of the device. This makes the numbers and characters of that month much easier to see. The structure of the device thereby allows a user to selectively increase the size of any desired portion of the calendar.

The embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A deformable calendar comprising:

a deformable member that is capable of fitting in a user's hand when said member is held by a user, wherein said member is capable of assuming a spherical shape, and wherein said member has a flexible outer covering that surrounds a deformable core;

a tabular register of indicia located on an exterior surface of the covering of the deformable member, said indicia including a plurality of groupings of numbers wherein each of said groupings corresponds to a particular calendar month and wherein each of said groupings is labeled with indicia that define the calendar month associated with said grouping and wherein said indicia further includes a group of numbers that indicate a calendar year associated with the groupings of months; and wherein the outer covering of the deformable member is made of a resilient material, and wherein a user can manually stretch a portion of said covering to thereby increase in size any of said indicia located on the surface of said stretched portion.

2. The deformable calendar of claim 1 wherein the outer covering of the deformable member is made of a rubber material.

3. The deformable calendar of claim 1 wherein the core is a tightly packed mass of individual particles.

4. The deformable calendar of claim 1 wherein said groupings of numbers corresponding to months of the calendar are separated from each other and wherein at least two of said groupings are located on opposite sides of the deformable member.

5. The deformable calendar of claim 1 wherein said groupings of numbers corresponding to months of the calendar are separated from each other and wherein at least two of said groupings are located on opposite sides of the deformable member.

6. A deformable calendar comprising:

a deformable member that is capable of fitting in a user's hand when said member is held by a user, and wherein said member has a flexible outer covering that surrounds a deformable core;

a tabular register of indicia located on an exterior surface of the covering of the deformable member, said indicia including at least one grouping of numbers that corresponds to a predetermined calendar month and wherein said at least one grouping of numbers is labeled with indicia that define the calendar month associated with said grouping; and wherein said indicia of said tabular register are arranged in columns and rows and wherein in a first shape of said deformable member, said columns are perpendicular to said rows and wherein a user can deform said deformable member so that said member assumes a second shape that is different from said first shape and in which said columns are non-perpendicular to said rows.

7. The deformable calendar of claim 6 wherein the outer covering of the deformable member is made of a resilient material, and wherein a user can manually stretch a portion of said covering to thereby increase in size any of said indicia located on the surface of said stretched portion.

8. The deformable calendar of claim 7 wherein the outer covering of the deformable member is made of a rubber material.

9. The deformable calendar of claim 6 wherein the core comprises a tightly packed mass of individual particles.

10. The deformable calendar of claim 6 wherein at least two groupings of numbers corresponding to predetermined months of a calendar are located on the outer covering of the deformable member and wherein said groupings of numbers are spaced from each other and wherein at least two of said groupings are located on opposite sides of the deformable member.

11. The deformable calendar of claim 6 wherein the deformable member can be manually shaped to assume a substantially ball-shaped form.

12. The deformable calendar of claim 11 wherein the deformable member can be deformed multiple times without damage and wherein once the member is in a spherical shape, a user can then manually deform the deformable member whereby said member will have an egg shape.

* * * * *